US011566821B2

(12) United States Patent
Bao et al.

(10) Patent No.: US 11,566,821 B2
(45) Date of Patent: Jan. 31, 2023

(54) CRYOCOOLER

(71) Applicant: SUMITOMO HEAVY INDUSTRIES, LTD., Tokyo (JP)

(72) Inventors: Qian Bao, Nishitokyo (JP); Mingyao Xu, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 0 days.

(21) Appl. No.: 16/570,011

(22) Filed: Sep. 13, 2019

(65) Prior Publication Data

US 2020/0003460 A1 Jan. 2, 2020

Related U.S. Application Data

(63) Continuation of application No. PCT/JP2018/008135, filed on Mar. 2, 2018.

(30) Foreign Application Priority Data

Mar. 15, 2017 (JP) ..... JP2017-049497

(51) Int. Cl.
*F25B 9/14* (2006.01)
*F25D 19/00* (2006.01)

(52) U.S. Cl.
CPC ..... *F25B 9/145* (2013.01); *F25D 19/006* (2013.01)

(58) Field of Classification Search
CPC .. F25B 9/145; F25B 41/04; F25B 9/14; F25D 19/006
See application file for complete search history.

(56) References Cited

U.S. PATENT DOCUMENTS

| | | | | |
|---|---|---|---|---|
| 5,623,240 | A | 4/1997 | Sakuraba et al. | |
| 9,410,725 | B2 | 8/2016 | Mitsubori | |
| 2010/0163325 | A1* | 7/2010 | Nakamura | H01M 4/70 180/68.5 |

FOREIGN PATENT DOCUMENTS

| | | | |
|---|---|---|---|
| JP | S62-140707 | U | 9/1987 |
| JP | H06-132567 | A | 5/1994 |
| JP | 2004-27866 | A | 1/2004 |

(Continued)

OTHER PUBLICATIONS

Okada, Cryopump device and operating method of cryopump device, 2002, Full Document (Year: 2002).*

(Continued)

*Primary Examiner* — Nael N Babaa
(74) *Attorney, Agent, or Firm* — HEA Law PLLC

(57) ABSTRACT

A cryocooler includes a first cylinder and a second cylinder, a first cooling stage, a second cooling stage, a radiation shield which is cooled by the first cooling stage, accommodates the second cooling stage, and shields the second cooling stage from radiant heat from an outside, and a temperature sensor which detects a temperature of the second cooling stage. A working gas is supplied into the first cylinder and the second cylinder to be expanded and is exhausted to the outside, an insertion hole through which an output cable of the temperature sensor passes through from an inside to an outside of the radiation shield is provided in the radiation shield, and the insertion hole is configured such that the radiant heat entering the radiation shield from the outside of the radiation shield is not directly radiated to the second cooling stage.

5 Claims, 5 Drawing Sheets

(56) References Cited

FOREIGN PATENT DOCUMENTS

| | | | | |
|---|---|---|---|---|
| JP | 2004027866 | A | * | 1/2004 |
| JP | 2004-233047 | A | | 8/2004 |
| JP | 2004233047 | A | * | 8/2004 |
| JP | 2009-270736 | A | | 11/2009 |
| JP | 2013-160393 | A | | 8/2013 |
| JP | 2016-57025 | A | | 4/2016 |

OTHER PUBLICATIONS

Inaguchi, Supercondutive magnet, 2004, Full Document (Year: 2004).*
English translation of International Search Report for PCT/JP2018/008135 dated May 22, 2018.
English translation of International Preliminary Report on Patentability for form PCT/IB/373 with PCT/ISA/237 of PCT/JP2018/008135 dated May 22, 2018.

* cited by examiner

CRYOCOOLER

RELATED APPLICATIONS

The contents of Japanese Patent Application No. 2017-049497, and of International Patent Application No. PCT/JP2018/008135, on the basis of each of which priority benefits are claimed in an accompanying application data sheet, are in their entirety incorporated herein by reference.

BACKGROUND

Technical Field

Certain embodiment of the present invention relates to a cryocooler which expands a high-pressure refrigerant gas to generate cold.

Description of Related Art

As an example of a cryocooler which generates a cryogenic temperature, a Gifford-McMahon (GM) cryocooler is known. In the GM cryocooler, a displacer reciprocates in a cylinder to change a volume of an expansion space. The expansion space is selectively connected to a discharge side and a suction side of a compressor according to the volume change, and thus, the refrigerant gas is expanded in the expansion space.

For example, in the related art, a multistage cryocooler having a plurality of stages of cooling unit is suggested. In general, a second or more stage of the multistage cryocooler has a small refrigeration capacity and is susceptible to radiant heat from the surroundings. Thus, the multistage cryocooler has a radiation shield for blocking the radiant heat.

SUMMARY

According to an embodiment of the present invention, there is provided a cryocooler including: a first cylinder and a second cylinder which is connected to each other in series; a first cooling stage which is provided on an end portion of the first cylinder on a side of the second cylinder; and a second cooling stage which is provided on an end portion of the second cylinder on a side opposite to the first cylinder. A working gas is supplied into the first cylinder and the second cylinder to be expanded and is exhausted to an outside, and thus, the first cooling stage is cooled to a first cooling temperature, and the second cooling stage is cooled to a second cooling temperature lower than the first cooling temperature, and the cryocooler further includes a radiation shield which accommodates the second cooling stage and shields the second cooling stage from radiant heat from the outside and a temperature sensor which is attached to the second cooling stage and detects a temperature of the second cooling stage. An insertion hole through which an output cable of the temperature sensor passes through from an inside to an outside of the radiation shield is provided in the radiation shield, and the insertion hole is configured such that the radiant heat entering the radiation shield from the outside of the radiation shield is not directly radiated to the second cooling stage.

According to another embodiment of the present invention, there is provided a cryocooler. The cryocooler includes a first cylinder and a second cylinder which is connected to each other in series, a first cooling stage which is provided on an end portion of the first cylinder on a side of the second cylinder, and a second cooling stage which is provided on an end portion of the second cylinder on a side opposite to the first cylinder. A working gas is supplied into the first cylinder and the second cylinder to be expanded and is exhausted to an outside, and thus, the first cooling stage is cooled to a first cooling temperature, and the second cooling stage is cooled to a second cooling temperature lower than the first cooling temperature, and the cryocooler further includes a radiation shield which accommodates the second cooling stage and shields the second cooling stage from radiant heat from the outside, and a temperature sensor which is attached to the second cooling stage and detects a temperature of the second cooling stage. An insertion hole through which an output cable of the temperature sensor passes through from an inside to an outside of the radiation shield is provided in the radiation shield, and the cryocooler further includes a shielding member which blocks the radiant heat trying to be directly radiated to the second cooling stage through the insertion hole.

DETAILED DESCRIPTION

Figure 1:
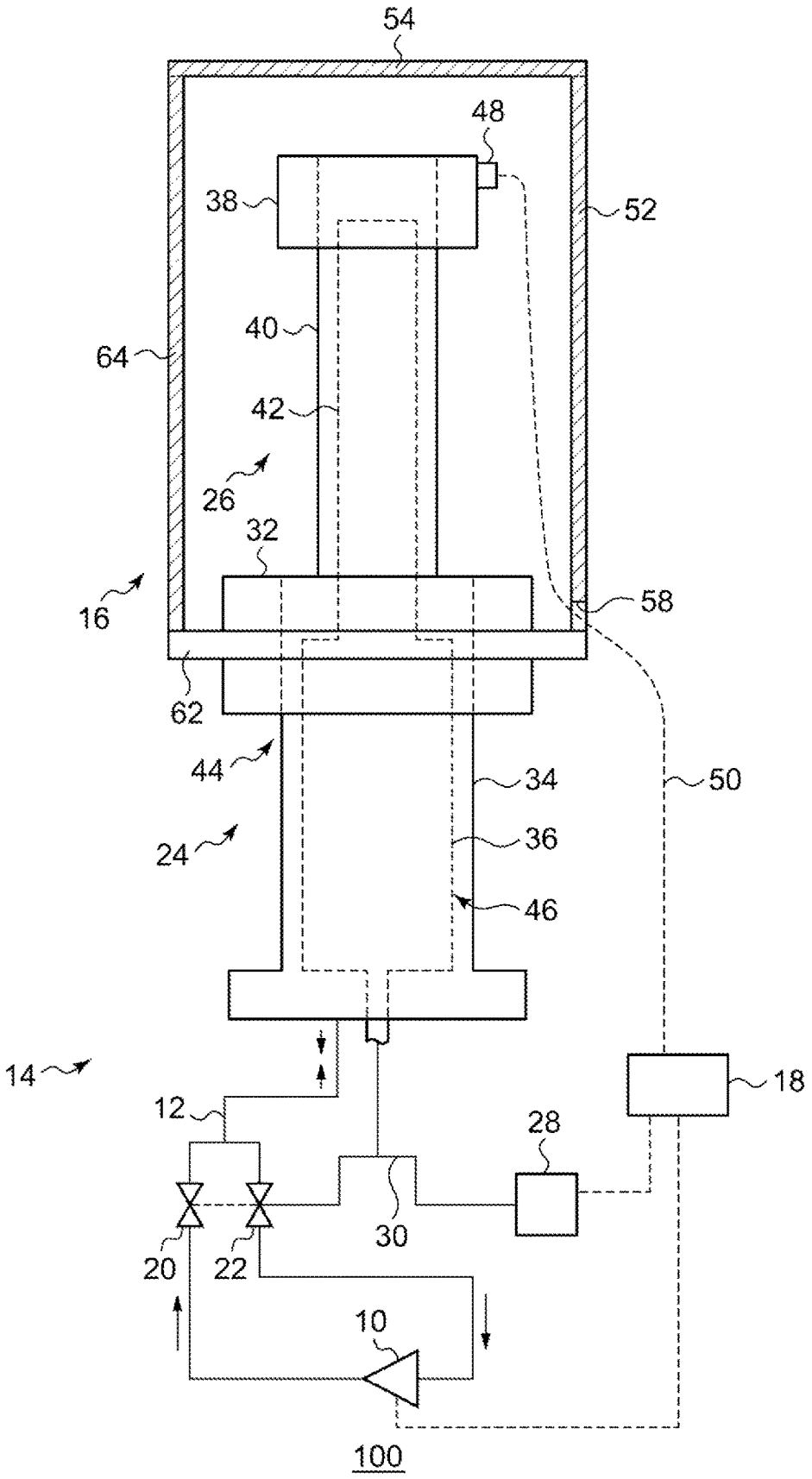
FIG. 1 is a diagram showing a cryocooler according to an embodiment.

As a result of intensive studies, the present inventors have recognized that there is room for improvement in a shield of radiant heat in order to improve cooling performance of a multistage cryocooler.

It is desirable to improve the cooling performance of the multistage cryocooler.

In addition, aspects of the present invention include arbitrary combinations of the above-described elements and mutual substitution of elements or expressions of the present invention among apparatuses, methods, systems, or the like.

According to the present invention, it is possible to improve cooling performance of a multistage cryocooler.

Hereinafter, the same reference numerals are assigned to the same or equivalent constituent elements, members, and processes shown in each drawing, and repeated descriptions will be appropriately omitted. In addition, dimensions of members in each drawing are shown appropriately enlarged or reduced for easy understanding. Moreover, in each drawing, a portion of members which are not important in describing an embodiment is omitted.

FIG. 1 is a diagram showing a cryocooler 100 according to an embodiment. In FIG. 1, a first radiation shield 62 is shown in a cross section. The cryocooler 100 is a Gifford-McMahon cryocooler (GM cryocooler). The cryocooler 100 is a two-stage type cryocooler, which combines two stages of cooling units in series to achieve a lower temperature as described below. The cryocooler 100 includes a compressor 10, a pipe 12, an expander 14, a radiation shield 16, and a controller 18.

The compressor 10 compresses a low-pressure refrigerant gas returned from the expander 14 and supplies a compressed high-pressure refrigerant gas to the expander 14. The pipe 12 connects the compressor 10 and the expander 14. A high-pressure valve 20 and a low-pressure valve 22 are provided in parallel in the pipe 12. A high-pressure working gas is supplied from the compressor 10 to the compressor 10 via the high-pressure valve 20 and the pipe 12. A low-pressure working gas is exhausted to the compressor 10 via the pipe 12 and the low-pressure valve 22. For example, a helium gas can be used as the refrigerant gas. Moreover, a nitrogen gas or another gas may be used as the refrigerant gas.

The expander 14 expands the high-pressure refrigerant gas supplied from the compressor 10 to generate cold. The expander 14 includes a first cooling unit 24, a second cooling unit 26, a drive motor 28, a connection mechanism 30, and a temperature sensor 48. The first cooling unit 24 includes a first stage 32, a first cylinder 34, and a first displacer 36. The second cooling unit 26 includes a second stage 38, a second cylinder 40, and a second displacer 42. The first cooling unit 24 and the second cooling unit 26 are connected to each other in series.

Hereinafter, a direction in which the first cylinder 34 and the second cylinder 40 extend is referred to as an axial direction, and a side where the second cylinder 40 is provided with respect to the first cylinder 34 in the axial direction is referred to as an upper side. In addition, the axial direction also coincides with a direction in which the first displacer 36 and the second displacer 42 move. Moreover, a direction perpendicular to the axial direction is referred to as a radial direction, a side away from the first displacer 36 and the second displacer 42 in the radial direction is referred to as an outer side, and a side close to the first displacer 36 and the second displacer 42 in the radial direction is referred to as an inner side. Moreover, these notations do not limit a posture in which the cryocooler 100 is used, and the cryocooler 100 can be used in any posture.

The first cylinder 34 and the second cylinder 40 are coaxially connected to each other in series to form one cylinder member 44. Similarly, the first displacer 36 and the second displacer 42 are coaxially connected to each other in series to form one displacer member 46. The cylinder member 44 is a hollow hermetic container which accommodates the displacer member 46 and guides a reciprocating movement of the displacer member 46 in the axial direction.

The first stage 32 is an annular member and is fixed to the first cylinder 34 so as to surround an upper end of the first cylinder 34. The second stage 38 is fixed to an upper end of the second cylinder 40 so as to surround the upper end of the second cylinder 40. The second stage 38 is cooled to a temperature lower than that of the first stage 32. For example, the second stage 38 is cooled to about 2K to 10K, and the first stage 32 is cooled to about 30K to 80K. The first stage 32 and the second stage 38 are formed of a material having a high thermal conductivity such as aluminum or copper.

The temperature sensor 48 is a temperature sensor for measuring a temperature of the second stage 38 and is attached to the second stage 38. The temperature sensor 48 detects the temperature of the second stage 38 at a predetermined cycle, and a detected value is output via an output cable 50. In the example of FIG. 1, the temperature sensor 48 is connected to the controller 18 by the output cable 50 and the detected value is output to the controller 18.

The drive motor 28 is connected to the displacer member 46 via the connection mechanism 30. For example, the connection mechanism 30 includes a scotch yoke mechanism. The displacer member 46 is integrally reciprocated in the axial direction by the drive motor 28 and the connection mechanism 30. In addition, the connection mechanism 30 is connected to the high-pressure valve 20 and the low-pressure valve 22 so as to selectively perform switching between opening of the high-pressure valve 20 and opening of the low-pressure valve 22 in conjunction with the reciprocation. That is, the connection mechanism 30 is configured to perform switching between supply and exhaust of the working gas in conjunction with the reciprocation of the displacer member 46.

The controller 18 controls the compressor 10 and the drive motor 28. For example, the controller 18 controls a pressure difference between a high pressure and a low pressure of the compressor 10 to a target pressure.

The radiation shield 16 accommodates the second cylinder 40 and the second stage 38, and suppresses penetration of radiant heat from the surroundings into the second stage 38. For example, the radiation shield 16 is formed of a material having a high thermal conductivity such as aluminum or copper. In order to reflect radiant heat, an outer surface of the radiation shield 16 may be bright-plated. The radiation shield 16 includes a first radiation shield 62 and a second radiation shield 64.

The first radiation shield 62 is a disk-shaped member and encloses the first stage 32. The first radiation shield 62 may be integrally formed with the first stage 32, or may be formed separately from the first stage 32 and then coupled to the first stage 32. For example, the first radiation shield 62 may be a flange for connecting the first stage 32 integrally formed with the first radiation shield 62 to a cooling object. The second radiation shield 64 has a bottomed cup shape in which a cylindrical portion 52 and a bottom portion 54 are integrally formed with each other. The second radiation shield 64 is fixed to the first radiation shield 62 such that an opening is closed by the first radiation shield 62 in a state where the bottom portion 54 is located on an upper side. The first radiation shield 62 and the second radiation shield 64 are thermally connected to the first stage 32, and thus, are cooled by the first stage 32. In the second radiation shield 64, a cable insertion hole 58 for passing through the output cable 50 of the temperature sensor 48 out of the second radiation shield 64 is formed.

Figure 2B:
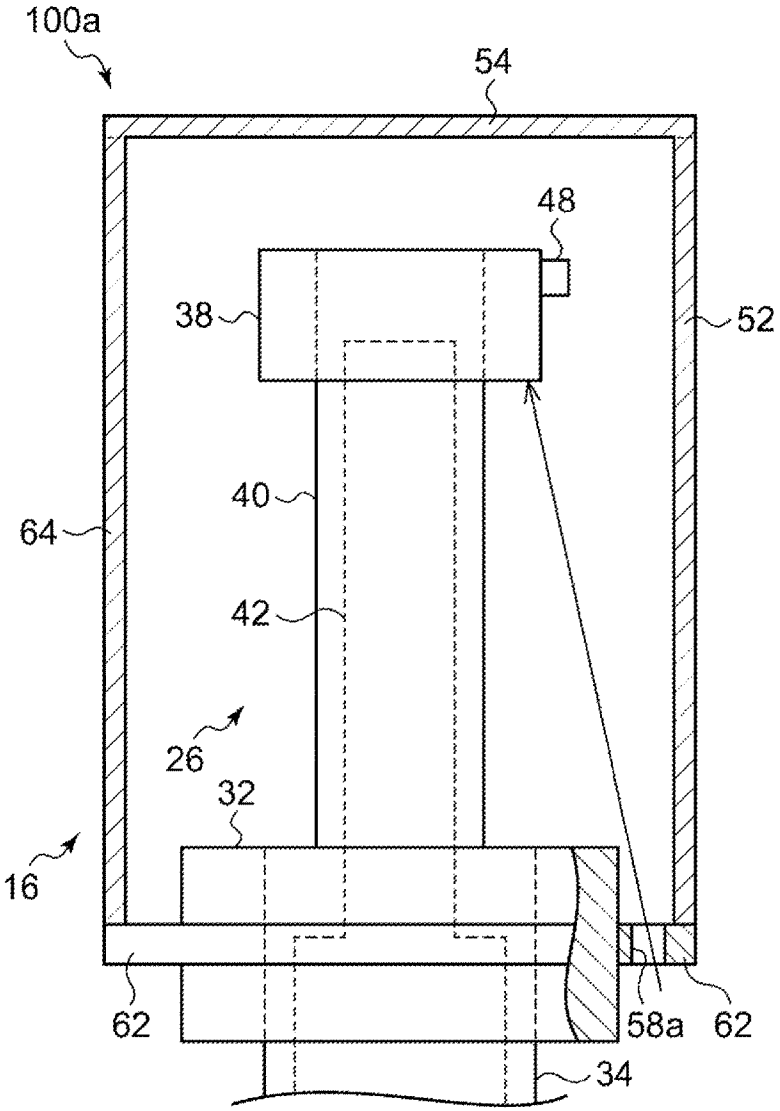
FIGS. 2A and 2B are schematic diagrams showing a cable insertion hole and a periphery thereof.
Figure 2A:
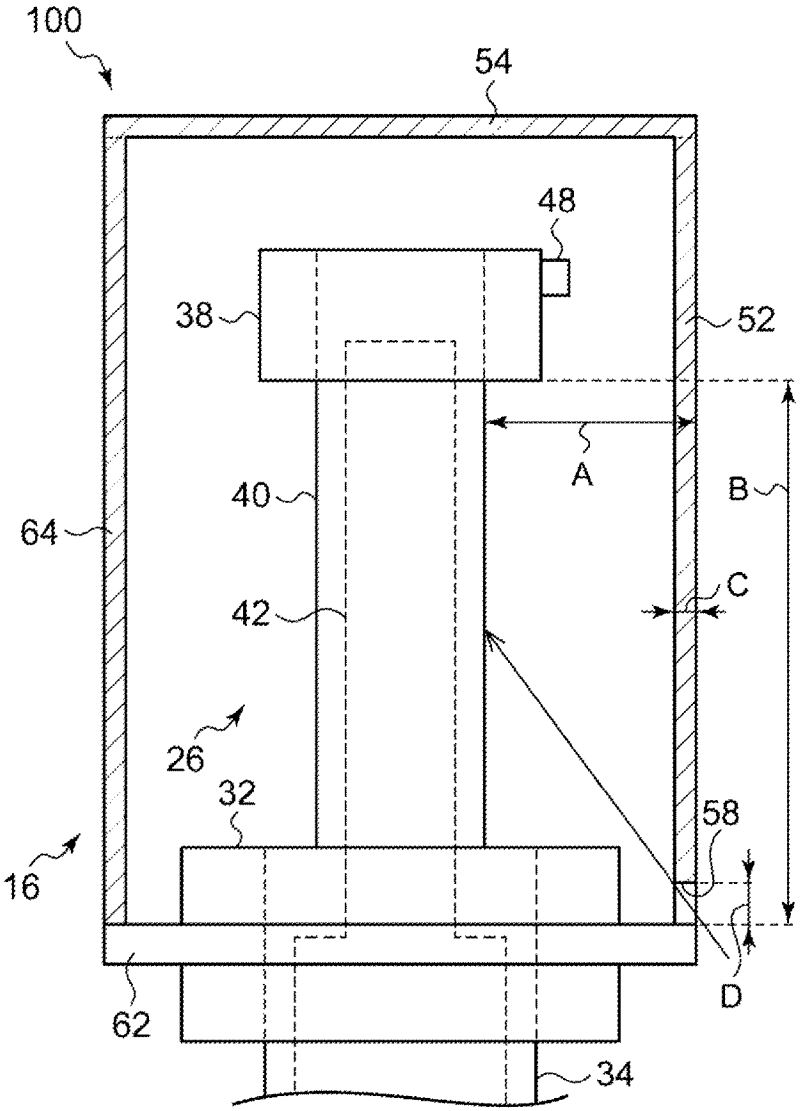

FIGS. 2A and 2B are schematic diagrams showing the cable insertion hole and a periphery thereof. FIG. 2A shows the cable insertion hole 58 of the cryocooler 100 according to the present embodiment and a periphery thereof, and FIG. 2B shows a cable insertion hole 58*a* of a cryocooler 100*a* according to a comparative example and a periphery thereof. In FIG. 2B, a portion of the first stage 32 and the first radiation shield 62 is shown in a cross section. In FIGS. 2A and 2B, the output cable 50 is not shown.

In the cryocooler 100*a* according to the comparative example shown in FIG. 2B, the cable insertion hole 58*a* is formed in the first radiation shield 62. Here, as a result of intensive studies, the present inventors found that the radiant heat which enters the radiation shield from the cable insertion hole, in particular, the radiant heat which enters the radiation shield from the cable insertion hole and is directly radiated to the second stage without being reflected by the second cylinder, an inner wall of the radiation shield, and a peripheral surface of the cable insertion hole has a relatively large effect on the cooling performance (reaching temperature) of the cryocooler. In the cryocooler 100*a* according to the comparative example, as shown by an arrow in FIG. 2B, the radiant heat which enters the radiation shield 16 from the outside of the second radiation shield 64 through the cable insertion hole 58*a* may be directly radiated to the second stage 38. That is, in the cryocooler 100*a* according to the comparative example, the cable insertion hole 58*a* has a position, a size, and a shape in which the radiant heat entering the radiation shield 16 from the outside of the second radiation shield 64 through the cable insertion hole 58*a* can be directly radiated to the second stage 38. Therefore, in the cryocooler 100*a* according to the comparative example, the cooling performance may be reduced.

In the cryocooler 100 according to the present embodiment shown in FIG. 2A, the cable insertion hole 58 is formed in the cylindrical portion 52 of the second radiation shield 64. The cable insertion hole 58 extends in the radial direction and penetrates the second radiation shield 64. In particular, the cable insertion hole 58 has a position, a size and, a shape in which the radiant heat which enters the radiation shield 16 from the outside of the second radiation shield 64 through the cable insertion hole 58 cannot be directly radiated to the second stage 38. In other words, the second stage 38 is provided at a position which avoids direct radiation of the radiant heat entering the radiation shield 16 from the cable insertion hole 58.

Specifically, in a case where the cable insertion hole 58 is provided below the second stage 38, that is, is provided on the second cylinder 40 side rather than the second stage 38 side, the cable insertion hole 58 is formed to satisfy the following Expression at all positions of the second stage 38.

$$A/B<C/D \quad \text{(Expression 1)}$$

Here, A indicates a radial distance between an outer peripheral surface of the cylindrical portion 52 and an inner peripheral surface (that is, an outer peripheral surface of the second cylinder 40) of the second stage 38, B indicates an axial distance from a lower end of the cable insertion hole 58 to a lower end of the second stage 38, C indicates a radial thickness of the second radiation shield 64, and D indicates an axial width of the cable insertion hole 58.

In this case, the radiant heat which tries to enter the radiation shield 16 from the cable insertion hole 58 is directly radiated to a peripheral surface of the second cylinder 40 or the cable insertion hole 58. That is, the radiant heat is reflected by the peripheral surface of the second cylinder 40 or the cable insertion hole 58, and thus, the radiant heat is not incident on the second stage 38, that is, is not directly radiated to the second stage 38.

An operation of the cryocooler 100 configured as described above will be described. The connection mechanism 30 opens the high-pressure valve. A high-pressure working gas is supplied to the expander 14 from the compressor 10 through the pipe 12. If an internal space of the expander 14 is filled with the high-pressure working gas, the connection mechanism 30 closes the high-pressure valve 20 and opens the low-pressure valve 22. The working gas is adiabatically expanded and discharged to the compressor 10 through the pipe 12. The displacer member 46 reciprocates inside the cylinder member 44 in synchronization with the supply and discharge of the working gas. By repeating this thermal cycle, the first stage 32 and the second stage 38 are cooled.

In this case, the radiant heat which enters the second radiation shield 64 through the cable insertion hole 58 can be directly radiated to the peripheral surface of the second cylinder 40 or the cable insertion hole 58. However, the radiant heat cannot be directly radiated to the second stage 38. Accordingly, the cooling performance of the cryocooler 100 is high compared to a case where the radiant heat is directly radiated to the second stage 38.

According to the cryocooler 100 of the present embodiment described above, the radiant heat entering the radiation shield 16 from the outside of the second radiation shield 64 through the cable insertion hole 58 is prevented from being directly radiated to the second stage 38. Accordingly, the cooling performance of the cryocooler 100 is improved.

Hereinbefore, the cryocooler according to the embodiment is described. It should be understood by a person skilled in the art that this embodiment is an example, various modification examples are possible for each of the constituent elements and combinations of processing processes, and the modification examples are also within a scope of the present invention. Hereinafter, modification examples are described.

First Modification Example

In the embodiment, the case where the cable insertion hole 58 is formed in the second radiation shield 64 is described. However, the present invention is not limited to this. The cable insertion hole 58 may be formed in the first radiation shield 62.

Figure 3:
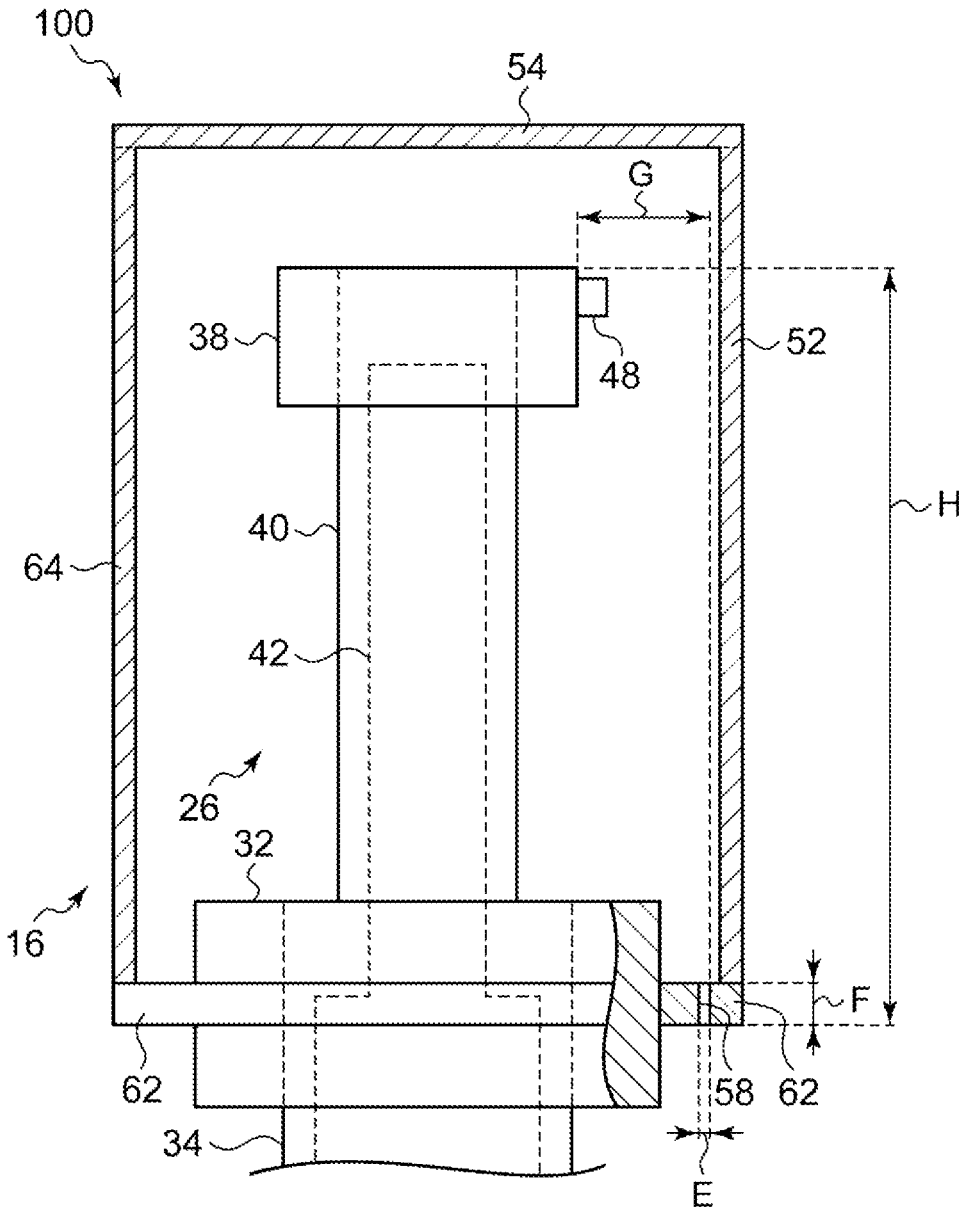
FIG. 3 is a schematic diagram showing a cable insertion hole of a cryocooler according to a modification example and a periphery thereof.

FIG. 3 is a schematic diagram showing a cable insertion hole of a cryocooler 100 according to the modification example and a periphery thereof. FIG. 3 corresponds to FIG. 2B. In the present modification example, the cable insertion hole 58 is formed in the first radiation shield 62.

The cable insertion hole 58 extends in the axial direction and penetrates the first radiation shield 62. Specifically, the cable insertion hole 58 is formed to satisfy the following Expression at all positions of the second stage 38.

$$E/F<G/H \quad \text{(Expression 2)}$$

Here, E indicates a radial width of the cable insertion hole 58, F indicates an axial thickness of the first radiation shield 62, G indicates a radial distance between an outer edge of the cable insertion hole 58 and an outer edge of the second stage 38, and H is a distance from a lower end of the first radiation shield 62 to an upper end of the second stage 38.

In this case, the radiant heat which tries to enter the second radiation shield 64 from the cable insertion hole 58 is directly radiated to the inner wall of the second radiation shield 64 or the peripheral surface of the cable insertion hole 58. That is, the radiant heat is not directly radiated to the second stage 38.

Second Modification Example

Figure 4:
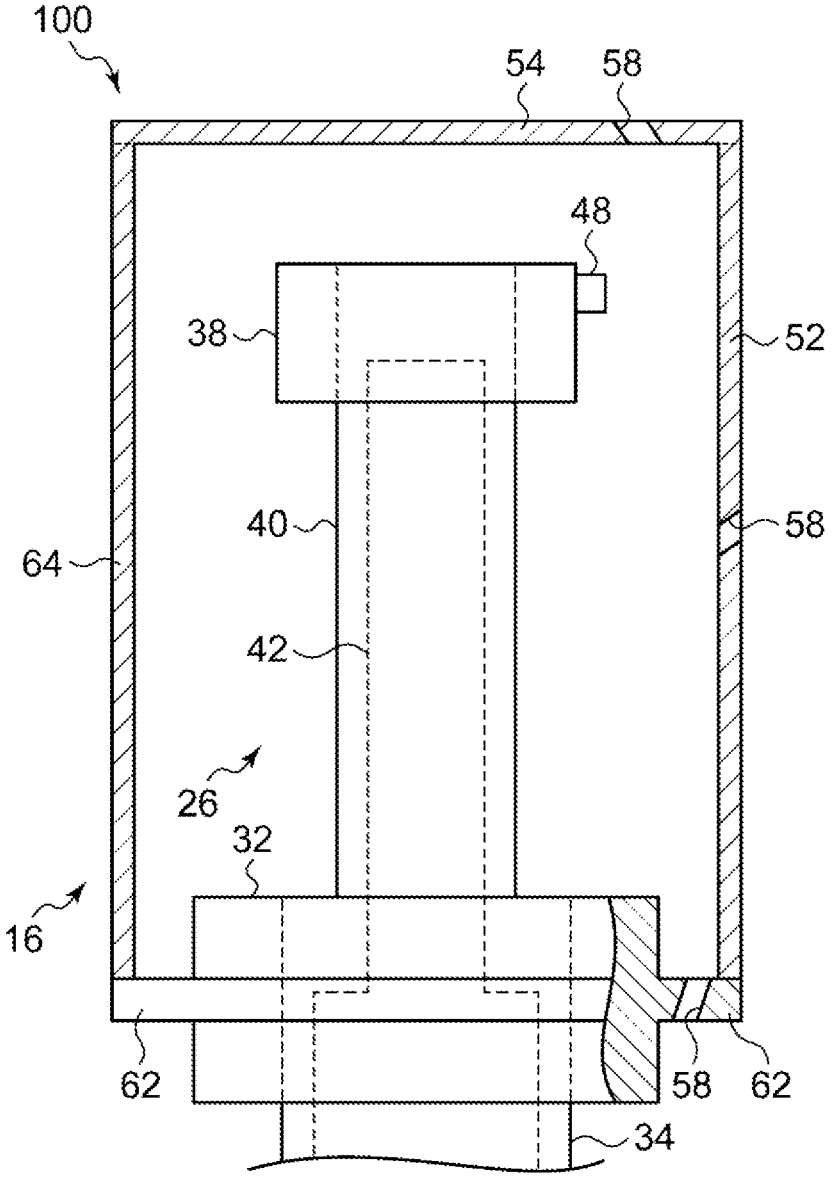
FIG. 4 is a schematic diagram showing a cable insertion hole of a cryocooler according to another modification example and a periphery thereof.

FIG. 4 is a schematic diagram showing a cable insertion hole 58 of a cryocooler 100 according to another modification example and a periphery thereof. FIG. 4 corresponds to FIG. 2B. In FIG. 4, a plurality of cable insertion holes 58 are shown. However, any one of the cable insertion holes 58 may be formed. In the present modification example, the cable insertion holes 58 are formed to extend in a direction intersecting the axial direction and the radial direction, and thus, the radiant heat is prevented from being directly radiated to the second stage 38. For example, the cable insertion hole 58 may extend away from the second stage 38 as it goes from the outside of the radiation shield 16 to the inside thereof.

Third Modification Example

In the embodiment and the modification examples described above, the radiant heat is prevented from being directly radiated to the second stage 38 by studying the position, size, and shape of the cable insertion hole 58. However, the present invention is not limited to this. That is, a shielding member may block a path of the radiant heat toward the second stage 38 such that the radiant heat is prevented from being directly radiated to the second stage 38.

Figure 5:
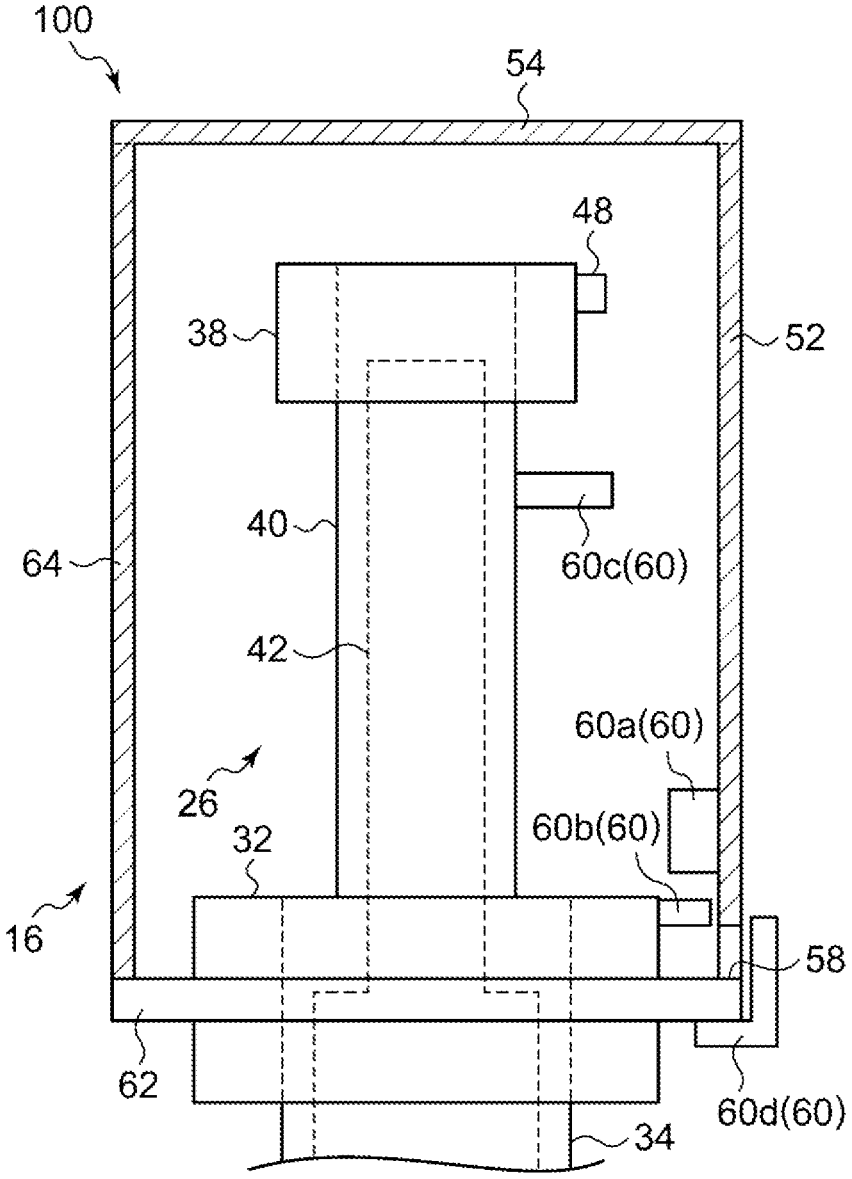
FIG. 5 is a schematic diagram showing a cable insertion hole of a cryocooler according to still another modification example and a periphery thereof.

FIG. 5 is a schematic diagram showing a cable insertion hole 58 of a cryocooler 100 according to still another modification example and a periphery thereof. FIG. 5 corresponds to FIG. 2A. In the present modification example, the cryocooler 100 further includes a shielding member 60. In addition, in FIG. 4, a plurality of the shielding members 60 are shown. However, at least one shielding member 60 may be provided. Moreover, in FIG. 4, the cable insertion hole 58 is formed in the second radiation shield 64. However, the cable insertion hole 58 may be formed in the first radiation shield 62.

For example, the shielding member 60 may be formed of a material having a high thermal conductivity such as aluminum or copper.

A shielding member 60*a* is a protrusion portion which protrudes from the inner wall of the second radiation shield 64 toward the second cylinder 40. The shielding member 60*a* may be integrally formed with the second radiation shield 64, or may be formed separately from the second radiation shield 64 and then supported by the second radiation shield 64.

A shielding member 60*b* is a protrusion portion which protrudes from an outer peripheral surface of the first stage 32 toward the inner wall of the second radiation shield 64. The shielding member 60*b* may be integrally formed with the first stage 32, or may be formed separately from the first stage 32 and then supported by the first stage 32.

A shielding member 60*c* is a protrusion portion which protrudes from the outer peripheral surface of the second cylinder 40 toward the inner wall of the second radiation shield 64. The shielding member 60*c* may be integrally formed with the second cylinder 40, or may be formed separately from the second cylinder 40 and then supported by the second cylinder 40.

That is, the shielding member 60*a*, the shielding member 60*b*, and the shielding member 60*c* are all provided between the cable insertion hole 58 and the second stage 38. In particular, the shielding member 60*a*, the shielding member 60*b*, and the shielding member 60*c* protrude to block the path of the radiant heat toward the second stage 38. Accordingly, the radiant heat is prevented from being directly radiated to the second stage 38.

In addition, in the shielding member 60*a*, the shielding member 60*b*, and the shielding member 60*c*, in order to reflect the radiant heat outward the first stage 32 and the radiation shield 16, a surface (that is, the surface on the opposite side to second stage 38) to which the radiant heat is directly radiated may be formed of a glossy surface. For example, the glossy surface may be plated.

The shielding member 60*d* is a cover member provided outside the second radiation shield 64 such that a portion of the shielding member 60*d* faces the cable insertion hole 58 after the output cable 50 passes through so as to prevent the radiant heat trying to be directly radiated to the second stage 38 from entering the second radiation shield 64 through the cable insertion hole 58. The shielding member 60*d* is fixed to the first radiation shield 62. The shielding member 60*d* may be removably fixed so as to be removable at the time of maintenance. For example, the shielding member 60*d* may be an aluminum tape or a tape whose surface is bright-plated.

According to the present modification example, even in a case where the cable insertion hole 58 is formed at a position where the radiant heat which tries to enter the radiation shield 16 from the insertion hole is directly radiated to the second stage 38, the same effects as those of the above-described embodiment can be obtained. Therefore, a degree of freedom in the position and size of forming the cable insertion hole 58 increases.

Fourth Modification Example

In the embodiment, the case where the cryocooler 100 is the two-stage type cryocooler is described. However, the present invention is not limited to this, and the number of stages of the cryocooler 100 may be three or more. For example, in a case where the cryocooler 100 is a three-stage type cryocooler, a first cylinder, a first cooling stage, a second cylinder, and a second cooling stage described in claims may be respectively realized by a second cylinder, a second cooling stage, a third cylinder, and a third cooling stage.

It should be understood that the invention is not limited to the above-described embodiment, but may be modified into various forms on the basis of the spirit of the invention. Additionally, the modifications are included in the scope of the invention.

The present invention can be used in the cryocooler which expands the high-pressure refrigerant gas to generate the cold.

What is claimed is:

1. A cryocooler comprising:

a first cylinder and a second cylinder which are connected to each other in series;

a first cooling stage which is provided on an end portion of the first cylinder on a side of the second cylinder;

a second cooling stage which is provided on an end portion of the second cylinder on a side opposite to the first cylinder;

a radiation shield, which is cooled by the first cooling stage, accommodates the second cooling stage, and shields the second cooling stage from radiant heat from an outside; and a temperature sensor which is attached to the second cooling stage and detects a temperature of the second cooling stage, wherein a working gas is configured to be supplied into the first cylinder and the second cylinder to be expanded, and exhausted to the outside, and thus, the first cooling stage is configured to be cooled to a first cooling temperature, and the second cooling stage is configured to be cooled to a second cooling temperature lower than the first cooling temperature, wherein an insertion hole, through which an output cable of the temperature sensor passes through from an inside to an outside of the radiation shield, is provided in the radiation shield, wherein the insertion hole is configured such that the radiant heat entering the radiation shield from the outside of the radiation shield is not directly radiated to the second cooling stage, wherein the insertion hole is configured such that the radiant heat entering the radiation shield from the insertion hole is directly radiated to the second cylinder, a peripheral surface of the insertion hole, or an inner wall of the radiation shield, wherein the insertion hole is formed such that A/B<C/D, wherein 'A' is a radial distance between an outer peripheral surface of the second cylinder and an inner surface of the radiation shield, 'B' is an axial distance from a lower end of the insertion hole to a lower end of the second cooling stage, 'C' is a radial thickness of the radiation shield, and 'D' is an axial width of the insertion hole, wherein the radiation shield includes a first radiation shield and a second radiation shield, wherein the first radiation shield encloses the first cooling stage, wherein the second radiation shield has an bottomed cup shape in which a cylindrical portion and a bottom portion are integrally formed with each other, wherein the second radiation shield is fixed to the first radiation shield so an opening is closed by the first radiation shield in a state where the bottom portion of the second radiation shield is located on an upper side of the first radiation shield, wherein the cable insertion hole is formed in the cylindrical portion of the second radiation shield, and wherein the cable insertion hole extends in the radial direction and penetrates the second radiation shield.

2. The cryocooler according to claim 1, the cryocooler further comprising:

a shielding member which blocks the radiant heat, wherein the insertion hole is formed at a position at which the radiant heat trying to enter the radiation shield from the insertion hole is directly radiated in a direction of the second cooling stage, toward the shielding member.

3. The cryocooler according to claim 2, wherein the shielding member is disposed between the insertion hole and the second cooling stage and is supported by the radiation shield or the first cooling stage, and wherein the shielding member is a protrusion portion which protrudes from an outer peripheral surface of the first cooling stage or from an inner wall of the second radiation shield.

4. The cryocooler according to claim 2, wherein the shielding member is a cover member which closes the insertion hole after the output cable passes through.

5. The cryocooler according to claim 2, wherein the shielding member includes a surface to which the radiant heat is directly radiated, and the shielding member is formed of a metal.

* * * * *